United States Patent [19]

Kan

[11] 3,980,225

[45] Sept. 14, 1976

[54] SELF-STANDING BAG

[75] Inventor: Osamu Kan, Kyoto, Japan

[73] Assignee: Dai Nippon Insatsu Kabushiki Kaisha, Tokyo, Japan

[22] Filed: Aug. 4, 1975

[21] Appl. No.: 601,506

[30] Foreign Application Priority Data

Dec. 25, 1974 Japan ..... 50-3574

[52] U.S. Cl. ..... 229/57; 229/48 T; 229/61

[51] Int. Cl.[2] ..... B65D 33/00

[58] Field of Search ..... 229/57, 58, 61, 53, 229/21, 1.5 B, 48 T

[56] References Cited

UNITED STATES PATENTS

| | | | |
|---|---|---|---|
| 2,240,599 | 5/1941 | Amberg | 229/1.5 B |
| 2,385,898 | 10/1945 | Waters | 229/1.5 B X |
| 3,380,646 | 4/1968 | Doyen et al. | 229/57 |
| 3,437,258 | 4/1969 | Kugler | 229/53 X |
| 3,438,567 | 4/1969 | Bell, Jr. | 229/57 |
| 3,799,914 | 3/1974 | Schmit et al. | 229/61 |
| 3,935,993 | 2/1976 | Doyen et al. | 229/58 X |

*Primary Examiner*—Stephen P. Garbe
*Attorney, Agent, or Firm*—Spensley, Horn & Lubitz

[57] ABSTRACT

A self-standing bag is made of two similar side wall sheets disposed in an opposng relation and a bottom wall sheet having two edges thereof heat-fused with the lower edges of the two side wall sheets and being folded along a central folding line into the interspace between the two side wall sheets to have an inverted V-shaped cross section, each of the two lateral edges of the bottom wall sheet being recessed from the lateral edges of the side wall sheets, whereby two lateral edges of the two side wall sheets are mutually joined directly, when subjected to heat-fusing operation, to form two-ply lap joints. The invention also provides method and apparatus for automatically producing the bag.

3 Claims, 19 Drawing Figures

SELF-STANDING BAG

BACKGROUND OF THE INVENTION

This invention relates to self-standing containers or bags and more particularly to a self-standing bag made of a blank in the form of film or sheet, which is heat-fused along at least two lateral edges thereof. The invention also relates to method and apparatus for automatically producing this self-standing bag.

Ordinarily, the blank from which conventional bags are to be produced, is made of basic sheet or foil of synthetic resin or metal. A film of paper, metal, polyester, nylon, or the like material, which is not heat-fusible, is coated on the surface of the basic sheet expected to become the outer surface of the bag, and a film of easily heat-fusible or heat-sealable synthetic resin such as polyethylene is coated on the other surface of the basis sheet to be brought into the inner surface of the bag when it is completed. Between the basic sheet and either one of the above described films, an intermediate layer of a suitable nature may be interposed if required.

For the production of a conventional bag, the blank is first cut into a configuration conforming to the developed shape of the bag. The blank thus cut into the above described configuration is then folded along a line conforming to the bottom line, and the lateral edges of the folded blank are heat-fused. However, the bag simply heat-fused along its lateral edges cannot stand by itself when it is filled with a content. In order to obviate this disadvantage, there has been proposed a bag with a bottom wall sheet of a substantial area for providing the bag with self-standing ability when it is filled with a content.

One example of such a self-standing bag is disclosed in Japanese Patent Publication No. 9704/1965. The bag disclosed therein comprises first and second side wall sheets of identical shape and size disposed in an opposing relation, and a separate bottom wall sheet which is folded along its centerline into a inverted V-shaped cross-section. The bottom wall sheet is interposed between the lower parts of the first and second side wall sheets, and the lower edges of the inverted V-shaped bottom wall sheet are heat-fused with the lower edges of the first and second side wall sheets.

Each of the three wall sheets of this known bag is made of sheet material with a heat-fusible film attached to the inner surface thereof and with a non-heat-fusible film on the outer surface thereof.

Thus, when the lateral side edges of the first and the second side wall sheets are subjected to heat-fusing operations all of the directly opposing surface of the lateral side edges of the side wall sheets are heat-fused and joined except in regions thereof where the lateral side edges of the bottom wall sheet are interposed.

In this known bag, a cutout or notch is further provided in each lateral side edge of the bottom wall sheet. Therefore, along the lower part of each lateral side edge of the bag produced, a first region wherein the two side wall sheets are directly fused together and a second region wherein the two side wall sheets are indirectly heat-fused with the intermediary of the double-folded edge of the bottom wall sheet are alternately formed because of the existence of the cutout, and an abrupt change in thickness occurs at transitional area between the first and second regions.

In this transitional area, insufficient fusing tends to occur, and since this area is exposed to the outside, the heat-fused structure therein tends to be broken easily.

Furthermore, because this bag requires the three wall sheets as starting blanks, means for supplying three separate blanks is required in manufacturing the bag. It is apparent that this makes the production of the bag complicated and costly.

SUMMARY OF THE INVENTION

Therefore, a primary object of the present invention is to provide a self-standing bag in which above described problems accompanying the conventional bag can be substantially overcome.

Another object of this invention is to provide a method for automatically producing self-standing bags, which is in itself simple and of a cost-saving nature.

Still another object of the invention is to provide an apparatus for producing self-standing bags, which is also simple and economical in construction and can operate automatically.

According to the present invention, there is provided an improved self-standing bag comprising identical first and second side sheets each having upper, lower, first-side and second-side edges respectively in opposed relation to corresponding edges of the other side wall sheet, and a bottom wall sheet having two opposite long edges integrally and contiguously joined respectively to the lower edges of the first and second wall sheets and two opposite short edges respectively recessed from the first and second side edges of the first and second side wall sheets thereby to form cutouts of a specific width, the bottom wall sheet being folded inwardly along the longitudinal centerline thereof into an inverted Vee shape in cross section and being interposed between the first and second side wall sheets to form a bag bottom recessed inwardly from the outside, the first and second side wall sheets being heat-fused together along regions at the first-side and second-side edges thereof to form therebetween lap joints of a width greater than the width of the cutouts, said short edges of the bottom wall sheet covered by said width of the lap joints being heat-fused with the adjoining surfaces of the side wall sheets.

In another aspect of the invention, there is provided a method for producing self-standing bags, comprising the steps of feeding a continuous strip of blank sheet in the direction of its length, folding the strip along its longitudinal centerline constituting a central folding line so as to form opposing halves contiguously joined along the central folding line, punching a series of slots of a specific width in the folded strip transversely thereof along and adjacent the central folding line at a predetermined pitch, forming two secondary folding lines on the strip on both sides of an in parallel with the central folding line while moving said two halves of the folded strip away from each other, depressing the part of the strip between the two secondary folding lines transversely to reverse the folding direction of said central folding line to form the strip into a W-shaped cross section, subjecting the strip to a transverse heat-fusing operation in a region thereof extending transversely and covering each of said slots, with a width broader than that of the slots, and cutting the strip successively along a transverse line bisecting the width of each of said slots.

In a further aspect of the invention, there is provided apparatus for producing self-standing bags, comprising means for feeding a continuous strip of blank sheet in the direction of its length, means for folding the strip along its longitudinal centerline as a central folding line to form opposing halves, punching means for forming a series of slots of a specific width in the folded strip transversely thereof along and adjacent the central forlding line at a predetermined pitch, means for moving the opposing halves of the strip away from each other and for simultaneously forming two secondary folding lines on the strip halves on both sides of and in parallel with the central folding line, means for depressing the part of the strip between the two secondary folding lines inwardly transversely of the strip to reverse the folding direction of the central folding line to form the strip into a W-shaped cross section after the strip has been formed with the secondary folding lines, transverse heat-fusing means for heat-fusing the strip in a region thereof extending transversely and covering each of said slots over a width broader than that of the slots, and means for cutting the strip successively along a transverse line bisecting the width of each of the slots.

DETAILED DESCRIPTION

Figure 1:
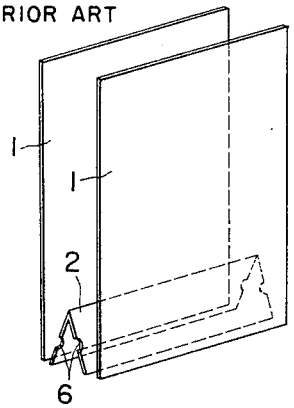
FIG. 1 PRIOR ART
FIG. 1 is a perspective view of a conventional self-standing bag prior to heat-fusion of its edges.

As conductive to a better understanding of the present invention, the construction of the previously described known self-standing bag will be described in more detail with reference to FIGS. 1, 2, and 3.

The self-standing bag shown comprises first and second wall side sheets 1 identical in shape and size, and a separate bottom wall sheet 2 having an inverted V-shaped cross-section interposed between the first and second side wall sheets 1, the sheets 1 and 2 being heat-sealed or heat-fused along the lateral side edges 3, lower edges 4, and a pair of oblique portions 5.

Figure 2:
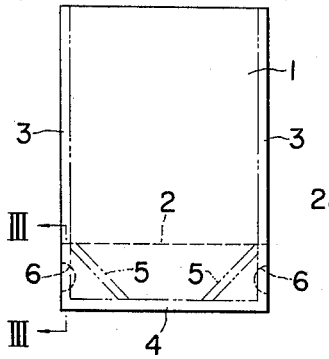
FIG. 2 PRIOR ART
FIG. 2 is a front elevational view of the same bag after being heat-fused.
Figure 3:
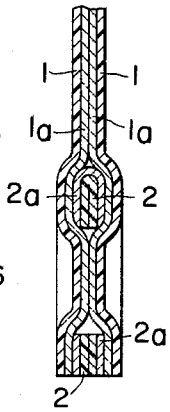
FIG. 3 PRIOR ART
FIG. 3 is an enlarged sectional view along the line III—III in FIG. 2.

In this known bag, at least a pair of cutouts 6 are provided in the lateral edges of the bottom wall sheet 2, and when the lateral edges 3 of the first and second side wall sheets 1 are heat-fused as described above, heat-fusible films 1*a* on these side wall sheets 1 are mutually heat-fused through these cutouts 6 as clearly indicated in FIGS. 2 and 3.

Thus, in each of the lateral side edges 3 of the first and second side wall sheets 1, there are formed in an alternate manner a first region wherein two layers of the first and second side wall sheets 1 are directly fused together, by the intermediary of their heat-fusible films, and a second region wherein four layers consisting of the first and second side wall sheets and the double-folded edge of the bottom wall sheet 2 are fused together through their heat-fusible films 1*a* and 2*a*. As will be apparent from FIG. 3, abrupt changes in thickness of the bag are present at the transitional areas between the two kinds of regions, where the heat-fusing tends to be defective.

Furthermore, in the known self-standing bag, the transitional areas abruptly changing in thickness are exposed to the outside on each lateral side of the bag. The exposure of the lateral edges of the transitional areas is not desirable because the heat-seal tends to be broken at these areas if the bag is filled with a heavy content and bumped against other objects during its transportation.

On the other hand, since the bag is formed by three separate sheets, the bag producing apparatus requires three separate sheet-supplying means for the three sheets, whereby the construction thereof is necessarily complicated.

According to the present invention, the above described difficulties of the conventional self-standing bag can be eliminated effectively.

Figure 4:
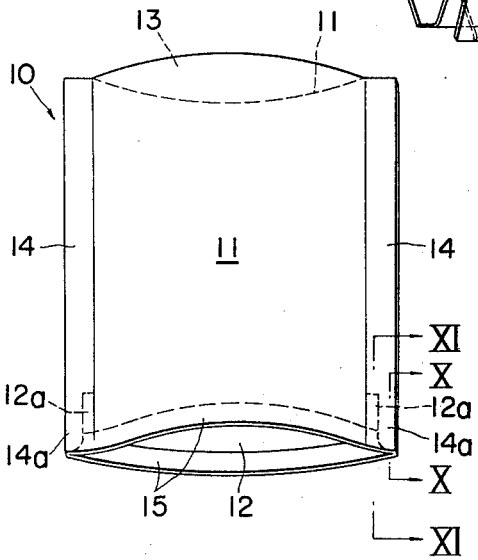
FIG. 4 is a perspective view of an example of a self-standing bag according to the present invention.

Referring to FIG. 4, the self-standing bag according to the present invention is generally designated by reference numeral 10 and comprises a pair of first and second side wall sheets 11 disposed in mutually opposing relation and a bottom sheet 12 provided at the lower part of the side wall sheets 11 to be interposed therebetween. The bag opens upwardly at 13, and the lateral side edges 14 of the first and second side wall sheets 11 are fused or joined together as will be described hereinafter with respective lateral side edges 12*a* of the bottom wall sheet 12 interposed therebetween. Thus, at regions along the lateral side edges 14 where the bottom wall sheet 12 does not exist, the lateral side edges 14 are directly heat-fused with each other.

Likewise, the lower edges of the first and second side wall sheets 11 are heat-fused with the front and rear edges of the bottom wall sheet 12 at portions 15 having a specific vertical width, so that the bottom wall sheet 12 can be constantly held at a higher level than the lower edges of the first and second wall sheets 11, whereby even in the case where the bag is filled with its content, the bottom wall sheet 12 is prevented from contacting with the floor or the surface of a table on which the self-standing bag is placed in erected condition.

The construction of the bag according to the present invention will further be described in more detail with reference to FIGS. 5 through 11.

Figure 5:
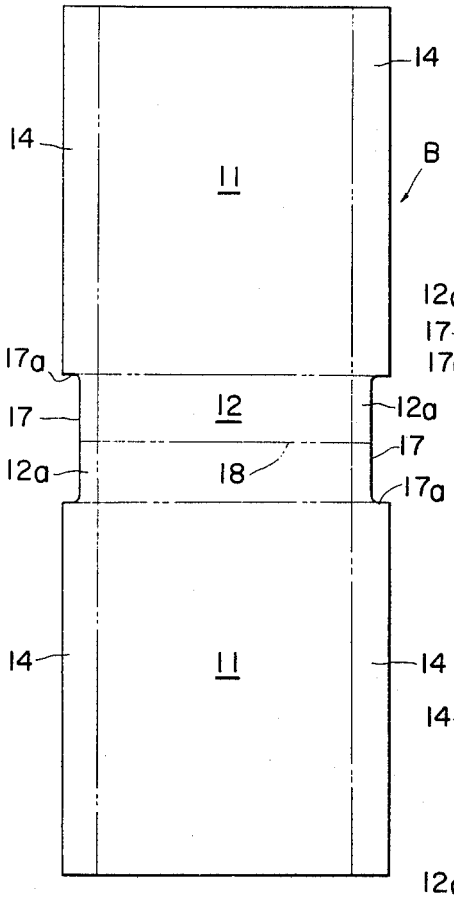
FIG. 5 is a developed view of a blank sheet from which the bag of the invention is produced.
Figure 7:
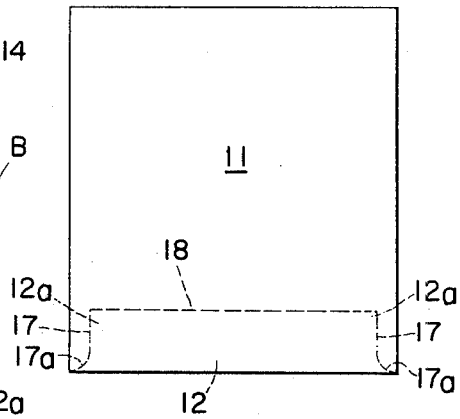
FIG. 7 is a front elevational view showing a state of the blank sheet wherein the folding operation has been completed.

The bag 10 is made from a sheet blank B cut into a configuration equivalent to the developed shape of the bag 10 as indicated in FIG. 5. More specifically, the blank B is formed in a single sheet having parts corresponding to the pair of the first and second side wall sheets 11 and the bottom wall sheet 12, contiguously and integrally connected together. The part corresponding to the bottom wall sheet 12 of the blank has two lateral side edges or short edges 12*a* respectively recessed inwardly from the lateral side edges 14 of the parts corresponding to the first and second wall sheets 11 thereby to form cutouts 17 of a specific width. It is desirable that the corners 17*a* at the ends of the short edges 12*a* be rounded, as indicated in FIG. 5, for preventing the blank from being ruptured at the corners 17*a*.

One surface of the blank B is coated with a film of known material having a heat-fusible nature, such as polyethylene, and the other surface of the same blank may be coated with a film of a material having no heat-fusible nature.

Figure 6:
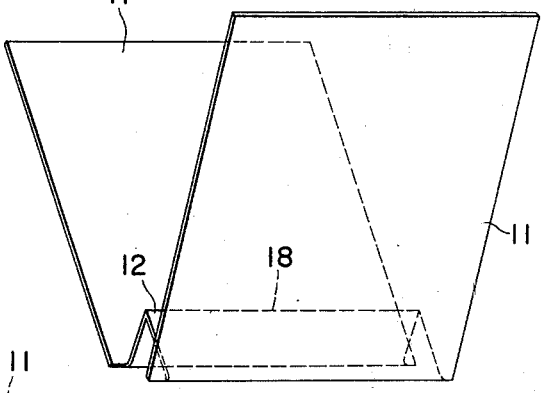
FIG. 6 is a perspective view showing a half-folded state of the same blank.

The blank B shown in FIG. 5 is then folded along folding lines as shown in FIG. 6. That is, the part of the blank B corresponding to the bottom sheet 12 is folded along its laterally extending centerline 18 so that a laterally extending ridge having an inverted V-shaped cross-section is thereby formed. Furthermore, the part of the blank B corresponding to the bottom wall sheet 12 is folded relative to the parts corresponding to the side wall sheets 11 along the boundary lines between the bottom wall sheet 12 and the side wall sheets 11, so that the aforementioned ridge is interposed between the lower parts of the side wall sheets 11, and the entire blank B is thereby formed to have a W-shaped cross section. In this case, the surfaces having the heat-fusible nature is brought to the inner side of the W-shaped blank, and the surface having no heat-fusible nature is brought to the outer side of the same. The above described folding operation is carried through until the opposing side wall sheets 11 of the blank are in close contact with each other.

Figure 8:
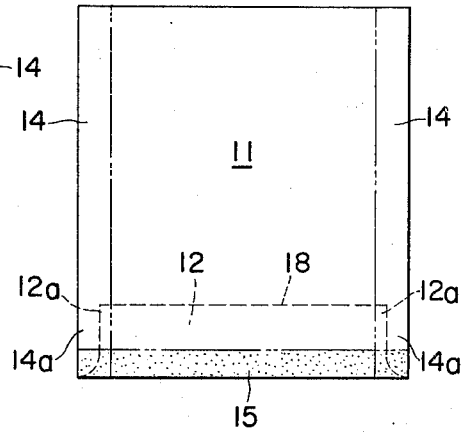
FIGS. 8 and 9 are front elevational views showing regions to be heat-fused of the blank which is in the state shown in FIG. 7.

Then, as shown in FIG. 8, the dotted regions 15 along the lower edges of the side wall sheets 11 delimited by a chain line are heat-fused between a pair of heating plates. Although the inner surfaces of the lower parts of the first and second side wall sheets 11 and the lower marginal parts of the bottom wall sheet 12 covered by the regions 15 are mutually heat-fused by this operation, the outer or under surfaces of the two limbs of the ridge of the bottom wall sheet 12, which are also in contact with each other, are not heat-fused because of their non-heat-fusible nature.

Since the regions 15 are heat-fused as described above, the bottom wall sheet 12 is raised from the floor or the surface of a table on which the bag is to be put, and any possibility of the bottom wall sheet 12 being damaged by contacting the floor or surface can be eluminated even in the case where the bag is filled with heavy content.

Figure 9:
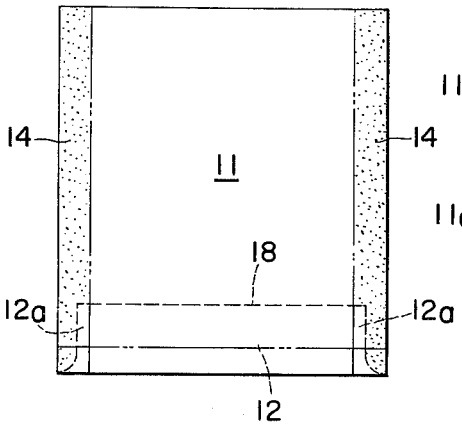

Then, the lateral side edges 14 of the side wall sheets 11 are subjected to heat-fusing in the dotted regions indicated in FIG. 9, so that the inner surface of the two sheets are joined or fused together in those regions. This heat-fusing process is also carried out by placing the lateral edges 14 between a pair of heating plates. In this case, the lateral edges 12*a* of the bottom wall sheet 12 interposed between the two side wall sheets 11 are also pressed by the heating plates. However, since only the surfaces of the lateral edges 12*a* of the bottom wall sheet 12 facing the side wall sheets 11 are made heat-fusible as described before, the fusion occurs only between these surfaces of the lateral edges 12*a* and the two side wall sheets 11, but not between the opposing under surfaces of the lateral edges 12*a* of the bottom wall sheet 12.

Figure 10:
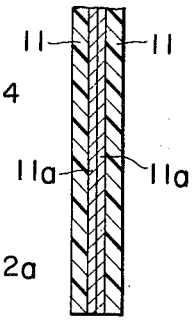
FIG. 10 is a sectional view on a much enlarged scale along the line X—X in FIG. 4.
Figure 11:
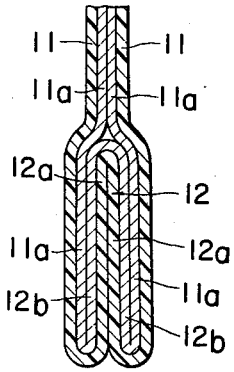
FIG. 11 is a sectional view on a much enlarged scale along the line XI—XI in FIG. 4.

As a result of the above-described heat-fusing operation, a self-standing bag 10 as shown in FIG. 4 is obtained. The heat-fusing relation between the two side wall sheets 11 and the bottom wall sheet 12 is clearly indicated in FIGS. 10 and 11 showing cross sections along lines X—X and XI—XI in FIG. 4, respectively. That is, at the laterally outer part of each side edge 14, the two wall sheets 11 are mutually heat-fused directly by the presence therebetween of the heat-fusible films 11*a*, thus providing a two-ply lap joint structure in that part. On the other hand, at the lower inner part of the side edge 14, the lateral edges 12*a* of the bottom wall sheet 12 are heat-fused with the two side wall sheets 11 through their heat-fusible films 11*a* and 12*b*, respectively, thus forming a four-ply structure in this part.

Between the part having the two-ply lap joint structure and the part having the four-ply structure, a region changing in thickness in a stepped manner is formed, the disadvantage of such a region having been described hereinbefore. In this example of the invention, however, the stepped region is not exposed to the outside as in the known bag but is protected by the two-ply heat-fused structure of the edges 14 provided in a part which is laterally further outside than the stepped region because of the previously described cutout 17. In other words, the outwardly exposed margins of the lateral edges 14 are of two-ply heat-fused structure, whereby there is little tendency of the margins of the edges 14 being broken or peeled off from each other.

Figure 12:
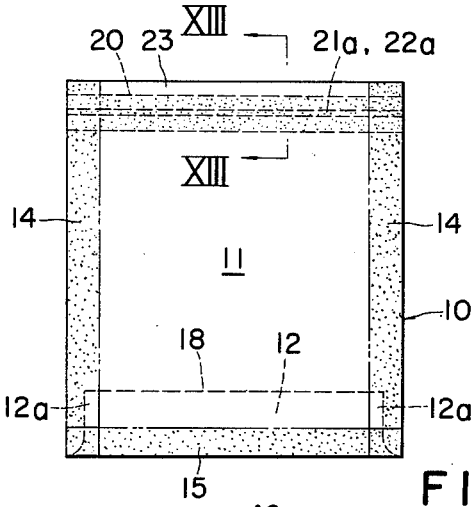
FIG. 12 is a front elevational view of another example of the bag of the invention wherein an openable sealing strap assembly is provided at the opening part of the bag shown in FIG. 4.
Figure 13:
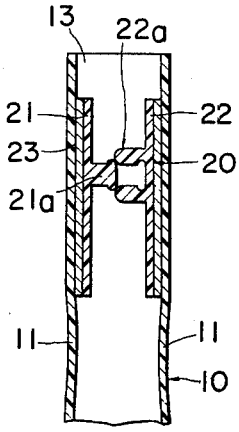
FIG. 13 is an enlarged sectional view taken along the line XIII—XIII in FIG. 12.
Figure 15:
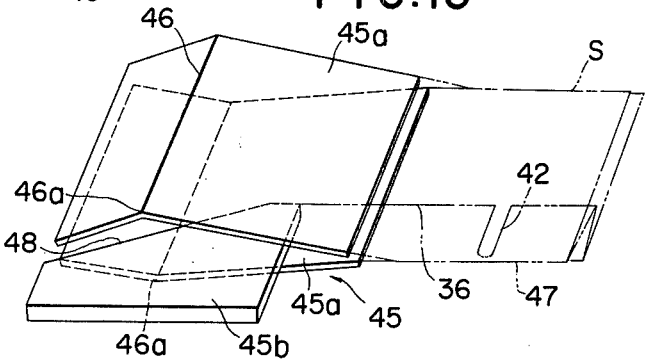
FIG. 15 is a relatively enlarged perspective view showing a part of the apparatus shown in FIG. 14A.

In FIGS. 12 and 13, there is illustrated another example of the bag according to the present invention, wherein a freely openable sealing strap assembly 20 of a conventional construction is heat-fused to the opening 13 of the self-standing bag 10. As is widely known, the strap assembly 20 comprises a pair of straps 21 and 22, and on these straps an elongated male member 21*a* and an elongated female member 22*a* are provided, respectively. The straps 21 and 22 are heat-fused to the first and second side wall sheets 11 at the parts thereof extending along the upper edges of the bag 10.

Figure 14A:
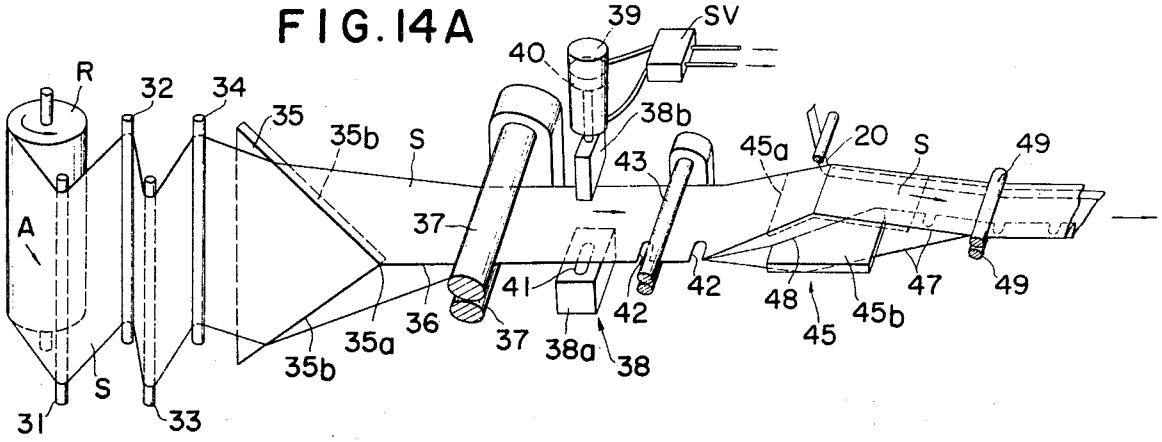
FIGS. 14A and 14B are diagrammatic perspective views showing an example of apparatus for producing the self-standing bag shown in FIG. 4.
Figure 14B:
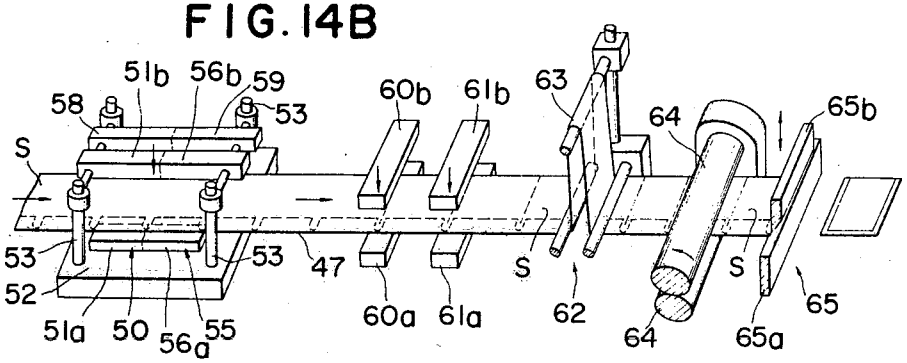

An apparatus for automatically producing the self-standing bag 10 according to the present invention is illustrated in FIGS. 14A and 14B.

In this apparatus, the self-standing bag 10 is automatically produced from a continuous strip S of sheet material. As shown in FIG. 14A, the strip S, which is a blank sheet for producing the bag, is paid out intermittently or stepwise in the arrow-marked direction A from a roll R of strip. After having passed through several sets of guide rollers 31, 32, 33, and 34, the strip S is passed over a double-folding device 35, which comprises a triangular plate disposed at an angle to the feeding direction of the strip S, and is folded by an apex 35*a* of the triangular plate along the centerline constituting a folding line 36 extending in the longitudinal direction of the strip S. During this operation, the strip S is guided by oblique sides 35*b* of the triangular plate to be gradually folded in a manner such that the strip halves divided by the folding line 26 are swung toward each other. The strip S is then passed and pressed between a pair of folding rollers 37 and the folding operation is thereby completed.

In the stage subsequent to the rollers 37, a punching device 38 is provided. The punching device 38 comprises a punching die 38*a* contacting and supporting the lower surface of the strip S, and a punch 38*b*. The punch 38*b* is connected to a piston 40 in a pneumatic or hydraulic cylinder 39, into which pressurized fluid is supplied through an electro-magnetic changeover valve SV. When the piston 40 is lowered, the punch 38*b* is moved into a hole 41 of the punching die 38*a*, and by repetition of the above described punching operation, a series of slots 42 are formed at predetermined intervals or pitch along the folding line 36 of the strip S. The stepwise feed of the strip S is carried out by means of driving rollers to be described later, and the above described punching operations are carried out while the strip S is stopped. Of course, the electromagnetic valve SV is operated in synchronism with the stepwise feed of the strip S.

The strip S thus subjected to the punching operations is passed through a pair of guide rollers 43 to a bottom wall sheet fold-in device 45. As shown in FIC. 15, the bottom wall sheet fold-in device 45 comprises a pair of strip guiding plates 45*a* arranged one above the other and bent respectively into a V-shaped cross section in a manner such that their intermediate transverse ridges 46 are more remote from each other than the other parts of the plates are, and a fold-in member 45*b* partly interposed therebetween. It will be seen from the figure that the two wings of each guiding plate 45*a*, divided by the ridge 46, form an obtuse angle on the side facing the outer guiding plate.

The fold-in member 45*b* has a cam edge 48 extending into the interspace between the two guiding plates 45*a*, with the degree of extension of the edge 48 into the interspace gradually increasing in the direction of feed of the strip or toward the trailing edge of the fold-in member 45*b*. Thus, when the doubled strip S is fed in the arrow-marked direction over the guiding plates 45*a* and through the fold-in member 45*b*, the upper and lower halves of the double-folded strip S are gradually moved away from each other by the upper and lower surfaces of the upper and lower guiding plates, respectively, and simultaneously therewith, the strip edge constituting the folding line 36 of the strip S is gradually depressed inwardly by the cam edge 48 of the fold-in member 45*b*. As a result, a pair of secondary folding lines 47 are newly formed in the strip on both sides of and in parallel with the central folding line 36 by sharp ends 46*a* of the ridges 46 of the guiding plates 45*a*, respectively, and the central folding line 36, being depressed by the cam edge 48, is reversed with respect to its transverse folding direction and forced into the interspace between the two guiding plates 45*a*. When the part being folded of the strip leaves the trailing edge of the fold-in member 45*b*, the central folding line 36 is completely forced inwardly, whereby a centrally folded intermediate strip part of V-shaped cross section is formed between the two upper and lower folded parts of the strip, the intermediate strip part and the upper and lower strip parts being divided by the two secondary folding lines 47.

Figure 16:
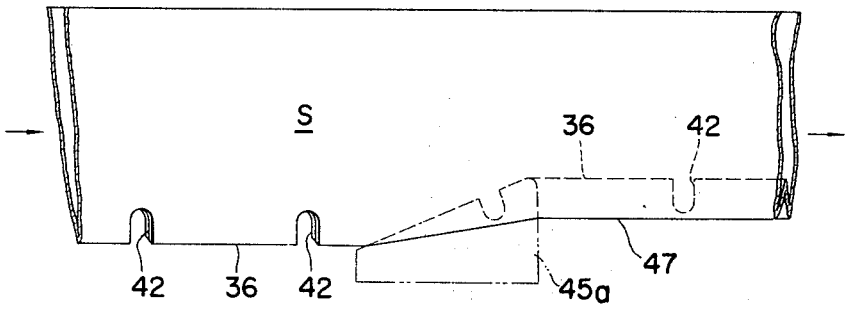
FIGS. 16 through 18 are plan views explanatory of successive steps carried out by the apparatus shown in FIGS. 14A and 14B on a folded blank strip.

The above described bottom wall sheet folding process is more clearly indicated in FIG. 16. Upon the reversal of the folding direction along the central folding line 36, the opening direction of the slots 42 is also reversed, and the part of the strip existing between any adjacent two slots 42 and between the secondary folding lines 47 is formed into the bottom wall sheet of the self-standing bag as will become apparent later.

After passing through the bottom wall sheet fold-in device 45, the strip S is sent through a pair of pressing rollers 49 to a bottom edge heat-fusing device 50 as shown in FIG. 14B.

In the case where the sealing strap assembly 20 is to be provided as shown in FIGS. 12 and 13 near the opening of the bag, elongated sealing straps 20 are applied to the internal surfaces of the double-folded strip in the bottom wall sheet fold-in process.

The bottom heat-fusing device 50 comprises a lower heating plate 15*a* securely mounted on a base 52, and an upper heating plate 51*b* which is movable vertically under the guidance of four columns 53. When part of the strip is held between the heating plates 51*a* and 51*b*, the lower edges (indicated at 15 in FIG. 8) along the folding lines 47 are heat-fused within a predetermined width. When the strip advances one step, the heat-fused lower edges are cooled by a cooling device 55 comprising lower cooling plate 56*a* and an upper cooling plate 56*b* which is movable up and down under the guidance of the columns 53. The heating plate 51*b* and the cooling plate 56*b* are both moved vertically by driving means (not shown) in synchronism with the intermittent movement of the strip. In the case where the sealing strap assembly 20 is provided, the elongated strap assembly may be heat-fused by the use of a separate heating plate 58 and a separate cooling plate 59 similar to the heating and cooling plates 51*b* and 56*b*.

Then, the strip is subjected to a heat-fusing operation and a cooling operation in its transverse direction. First, the strip is held between a lower stationary heating plate 60*a* and an upper movable heating plate 60*b* and is heat-fused. Secondly, the transversely heat-fused part of the strip is shifted between a lower stationary cooling plate 61*a* and an upper movable cooling plate 61*b* to be cooled therebetween.

Figure 17:
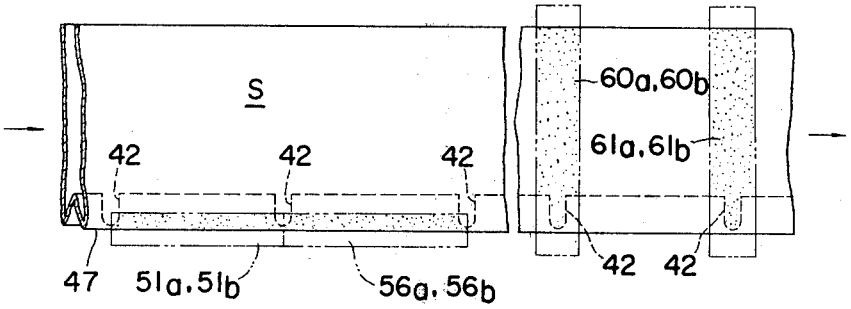

The above described heat-fusing operations and cooling operations are carried out in a positional relation as shown in FIG. 17. The heat-fusing along the folding lines 47 is carried out in the region extending between any two adjacent slots 42, and the cooling of the region is carried out at a position in the apparatus advanced from the heat-fusing position by one pitch of the intermittent feed of the strip. On the other hand, the heat-fusing in the transverse direction of the strip is carried out at the position of each slot 42 with a width broader than that of the slot 42, and likewise the cooling of the thus heat-fused part of the strip is carried out at a position in the apparatus advanced from the transverse heat-fusing position by one pitch of the feed of the strip. The sequence of these two heat-fusing operations together with the cooling operations may be reversed from that described above, and alternatively these two heat-fusing operations accompanied with by cooling operations may be effected simultaneously.

The strip S is then passed through a slot-position adjusting device 62. The device 62 comprises a vertically adjustable roller 63, by which the phase of the punched slots 42 in the subsequent stage in relation to the intermittent operation of the apparatus can be adjusted in a simple manner.

Figure 18:
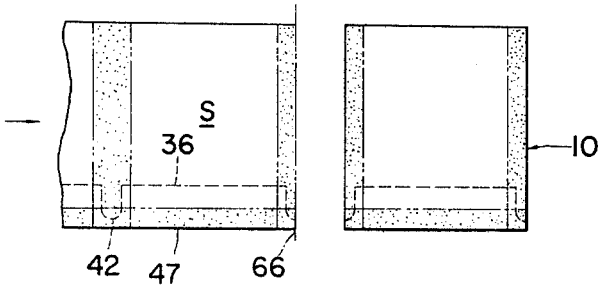

The strip S passed through the slot-position adjusting device 62 is passed between two rollers 64, which positively drive the strip S in stepwise or intermittent motion, and then passed through a strip cutting device 65. The device 65 has a fixed blade 65*a* and a vertically movable blade 65*b*. By this device 65, the strip S is cut, as shown in FIG. 18, along a transverse line 66 extending exactly in the center of the breadth of the transversely heat-fused area of the strip covering each slot 42, so that self-standing bags 10 each as shown in FIG. 4 are successively obtained. It will be understood that the central folding line 36 of the strip S corresponds to the folding line 18 of the bottom wall sheet 12 of the bag 10, and the secondary folding lines 47 correspond to the lower marginal edges of the first and second side wall sheets 11 of the bag.

Though not shown in the drawings, two sets of the above described apparatus as shown in FIGS. 14A and 14B may be arranged side-by-side in a symmetrical manner, so that a strip of twice the width of the above-mentioned strip S is supplied from a single roll, two halves thereof being processed as described above, and the strip thus processed is cut into two parts by a slitter along its longitudinal centerline. By this way, two series of identical bags can be produced in parallel.

When it is desired to provide automatically, the openable sealing strap assembly 20 as shown in FIGS. 12 and 13, mutually and previously engaged elongated straps for providing the strap assembly 20 are supplied at a stage indicated at the right-hand end in FIG. 14A in a manner such that the elongated straps are fed through the opening of the double-folded strip S. The elongated straps thus fed into the interior of the double-folded strip S are preferably heat-fused automatically to the strip at positions as indicated in FIGS. 12 and 13.

As will be apparent from the above description, the self-standing bag according to the present invention is far more advantageous than the conventional bag of this kind in that the sealing structure of the heat-fused parts are complete, thus reducing the possibility of its breakage, and the bottom sheet wall of the bag is well protected from any damage caused by directly contacting the floor or the like. It will also be apparent that the present invention has provided novel method and apparatus for automatically producing the bag in a reliable and efficient manner.

I claim:

1. A self-standing bag comprising identical first and second side wall sheets each having upper, lower, first-side and second-side edges respectively in opposed relation to corresponding edges of the other side wall sheet, and a bottom wall sheet having two opposite long edges integrally and contiguously joined respectively to the lower edges of said first and second side wall sheets and two opposite short edges respectively recessed from the first and second side edges of said first and second side wall sheets thereby to form cutouts of a specific width, said bottom wall sheet being folded inwardly along the longitudinal centerline thereof into an inverted Vee shape in cross section and being interposed between the first and second side wall sheets to form a bag bottom recessed inwardly from the outside, the first and second side wall sheets being heat-fused together along regions at the first-side and second-side edges thereof to form therebetween lap joints of a width greater than said width of said cutouts, said short edges of the bottom wall sheet covered by said width of the lap joints being heat-fused with the adjoining surfaces of said side wall sheets.

2. The self-standing bag as set forth in claim 1, wherein said first and second side wall sheets are heat-fused to the bottom wall sheet along regions respectively at said long edges of the bottom wall sheet to form therebetween lap joints of a specific width.

3. The self-standing bag as set forth in claim 1, further including openable sealing means secured along said upper edges of said side wall sheets and consisting of a pair of releasably engaged straps.

* * * * *